United States Patent [19]

Cupp

[11] Patent Number: 4,926,161

[45] Date of Patent: May 15, 1990

[54] METHOD OF MONITORING GOLF CARTS ON A GOLF COURSE

[76] Inventor: Ted W. Cupp, R.D. 6, Box 376, Rome, N.Y. 13440

[21] Appl. No.: 425,019

[22] Filed: Oct. 23, 1989

[51] Int. Cl.[5] ..... G08B 13/14

[52] U.S. Cl. ..... 340/572; 340/825.69; 455/53; 180/167

[58] Field of Search ..... 340/572, 539, 988, 990, 340/825.69, 825.72, 932.2; 364/444, 449; 455/53, 54; 180/167

[56] References Cited

U.S. PATENT DOCUMENTS 4,297,701 10/1981 Henriques ..... 364/561

*Primary Examiner*—Joseph A. Orsino
*Assistant Examiner*—Geoff L. Sutcliffe
*Attorney, Agent, or Firm*—Katherine McGuire

[57] ABSTRACT

A method of monitoring from a remote location each of a plurality of golf carts as they travel through a golf course. The Pro Shop, or other convenient location, and each golf cart are equipped with both transmitting and receiving apparatus such that wireless, two-way signals for a variety of communications may be sent between the carts and Pro Shop. Additional receiving and transmission apparatus is provided at a fixed location remote from the carts and Pro Shop such that the Pro Shop may receive signals which will establish the bearings of each cart on the course. Through circuitry and computer programming which performs triangulation procedures on the signals, the locations of each cart on the course are displayed upon a monitor board. From the location information thus received, warning signals may be sent to the carts of slow playing groups which are causing bottlenecks at particular holes. Other communications may be received and sent from the Pro Shop and carts, such as medical emergency, cart malfunction and/or impending inclement weather.

12 Claims, 3 Drawing Sheets

METHOD OF MONITORING GOLF CARTS ON A GOLF COURSE

BACKGROUND OF THE INVENTION

This invention relates to methods of monitoring from a remote station the locations of each of a plurality of golf carts as they progress around a golf course, and more particularly to methods of communicating various types of information between a Pro Shop, or other remote location, and golfers using carts the position of which is monitored at the remote location.

The present invention is directed to solving certain basic problems associated with the business of operating a golf course. The first problem the invention addresses is the monetary impact of the absence of an effective system by which to monitor the progress of golfers around the course to prevent bottlenecks due to slow play. As golfers exceed the normal time to complete a hole, queues begin to develop, the sizes of which depend on the number of golfers using the course. On particularly busy days, large queues may develop behind slow playing groups with one or more holes ahead of such groups being vacant. This reduces the number of potential golfers which may play through the course, thereby reducing the projected maximum revenue the course should realize on that day. In addition, slow-playing golfers or groups constitute an annoyance and general disruption of orderly play.

The second problem the invention addresses is the absence of means by which golfers may notify the Pro Shop of a malfunctioning golf cart when the golfer is out on the course a significant distance from the Pro Shop. Heretofore, the stranded golfer would have to leave the cart where it broke down and walk the rest of the way, either to finish playing the course or back to the Pro Shop to get a new cart, assuming there was no immediate help nearby.

Other problems addressed are the present lack of speedy and effective means of notifying the Pro Shop or other central location of a medical emergency on the course, and/or to notify golfers to leave the course due to severe weather conditions, or the like.

It is therefore a main object of the present invention to provide a method of monitoring a varying number of golf carts on a golf course such that the location of each cart can be readily determined at a remote location, such as a monitor station, by performing computerized triangulation on transmitted signals from each golf cart.

It is a further object of the present invention to provide a method of expediting play on a golf course by supplying a perceptible signal from a remote location to a predetermined golf cart, the signal indicating to the golfers using the cart that they are exceeding given time restraints at a particular location.

It is another object to provide a golf cart with a transmitter which emits a coded signal as part of the signal transmitted from the cart which coded signal represents a unique identification number, to facilitate monitoring the progress and location of carts on the course.

It is still another object of the present invention to provide a golf cart with means of supplying a perceptible signal to a remote location of cart malfunction, and/or of a medical emergency on the course.

Other objects will in part be obvious and in part appear hereinafter.

SUMMARY OF THE INVENTION

The present invention is characterized by a method of monitoring the various locations of a plurality of golf carts on a golf course from a central, remote location, such as the Pro Shop of the golf course. The method also includes means for two-way signal communication between each cart and the Pro Shop.

The invention involves providing the Pro Shop, or other convenient location, and each individual golf cart, with both transmission and receiving apparatus. The golf carts each include a transmitter which emits a signal only when an attached sensor perceives ignition of the golf cart such that parked golf carts whose engines are not running will not transmit any signals. The cart transmitter, when actuated by an operating cart, emits a signal which is picked up by a receiver at the Pro Shop. Other digitally coded information relating to cart identification can also be transmitted by the transmitter. A timing mechanism controls the signal such that it emits only at predetermined intervals to avoid reception of simultaneous signals from more than one cart. Means are also provided to override the on-off sensor such that the golfer may signal the Pro Shop of an unintentional "off" condition of the cart, i.e., in cases of cart malfunction.

The Pro Shop, or other cart monitoring location, includes a receiver which picks up the transmission signals from the golf carts on the course, such signals providing both cart identification and a directional bearing of the cart from the monitoring location. The receiver is attached to a computer which includes programming that will perform conventional tirangulation procedures on the received signals, thereby providing the location of each transmitting cart. The computer is attached to and relays its computed information to a monitor screen which includes a plan view of the golf course displayed on the screen. Through the use of LED's and internal circuitry, the location information received from the computer displays on the monitor screen an indication of the location of the source of each transmission. In this way, the precise locations of the golf carts on the course can be monitored at a remote location. The Pro Shop also includes a transmitter to selectively signal a predetermined cart that slow play is causing congestion on the course and must be expedited. Each golf cart includes a receiver which is connected to a warning alarm such as a buzzer, for example, which is activated by the signal sent by the Pro Shop. When the buzzer sounds on a particular cart, the golfers must either move on to the next hole within a predetermined time period or risk being ejected from the course. It is contemplated that verbal communication means may be implemented in addition to, or in place of, audible signals.

In the preferred embodiment, each golf cart also includes means by which the golfer may initiate a transmission to alert the Pro Shop that his cart is malfunctioning. This transmission would appear on the course layout of the monitor screen at the particular location of the cart on the course and be digitally coded such that it is distinguishable from other, properly functioning carts on the course. In an alternate embodiment, the malfunction signal may be transmitted automatically in response to absence of power to the cart motor due to factors other than turning off the ignition switch. Other, optionally included features are means for transmitting a further, uniquely coded signal from the carts to notify the Pro Shop of a medical emergency, or the like, on the course, and means providing voice communication from the Pro Shop to the carts.

DETAILED DESCRIPTION

Figure 1:
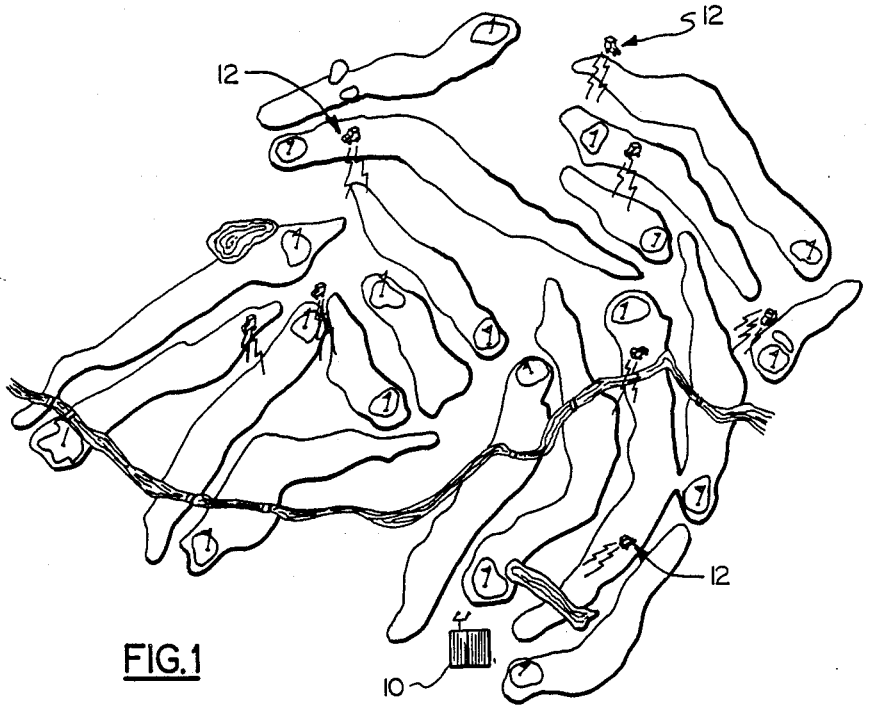
FIG. 1 is a plan view of a typical, eighteen hole golf course.
Figure 2:
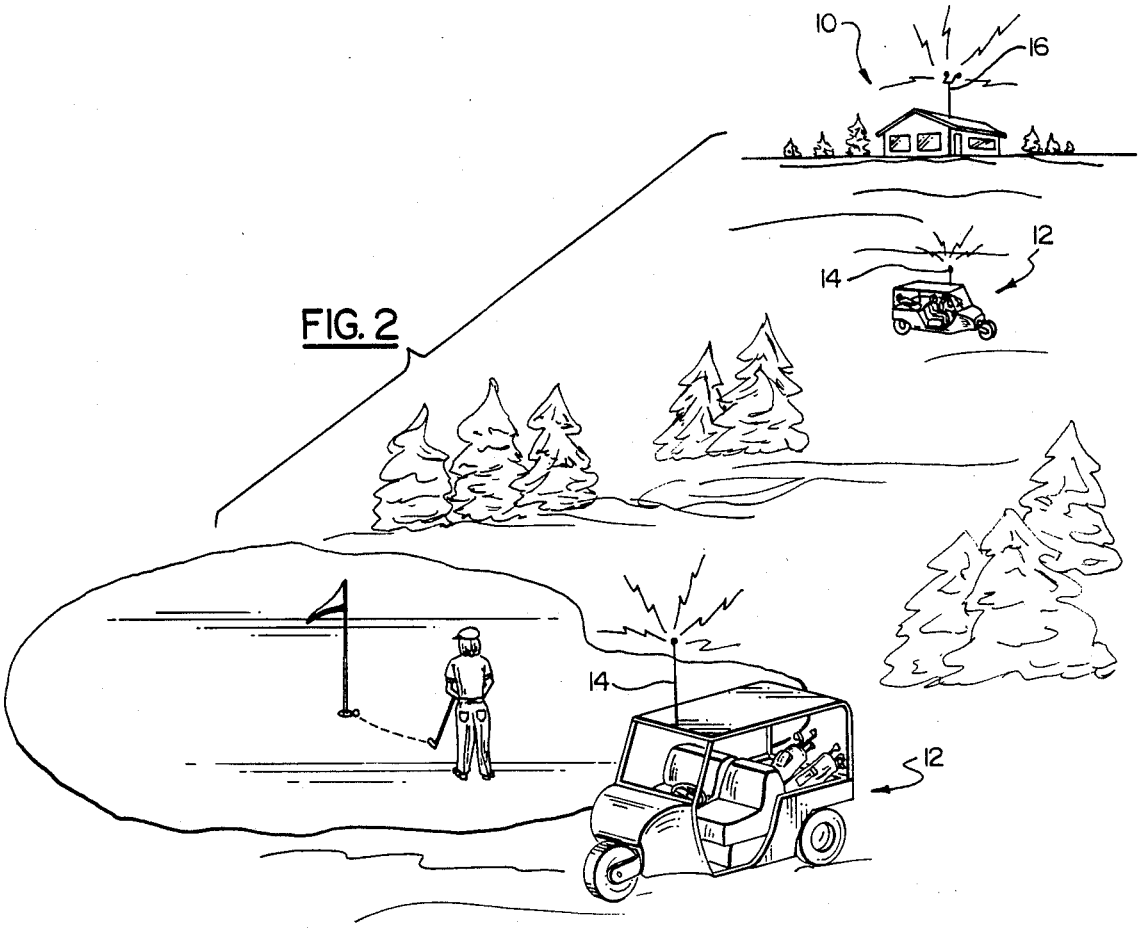
FIG. 2 is a perspective view of a portion of the golf course of FIG. 1 showing the Pro Shop and and golf carts at various locations on the course.

Turning attention to the drawings, there is seen in FIG. 1 a plan view of a typical eighteen hole golf course showing the centralized, remote location of a Pro Shop or other monitoring station 10 with respect to a plurality of golf carts, some of which are referenced by the numeral 12. As can be seen more clearly in FIG. 2, monitor station 10 and carts 12 include antennae 14 and 16, respectively, which are adapted to both transmit and receive RF or other wireless signals. The method of the invention involves maintaining communication signals between monitor station 10 and the golf carts 12 such that the locations of golf carts 12 may be readily determined via computing means at monitor station 10. In this way, an attendant at station 10 may easily observe the progress of carts 12, as they travel around the course, the purpose being to prevent slow play which tends to cause bottlenecks at each hole of the course.

Figure 3:
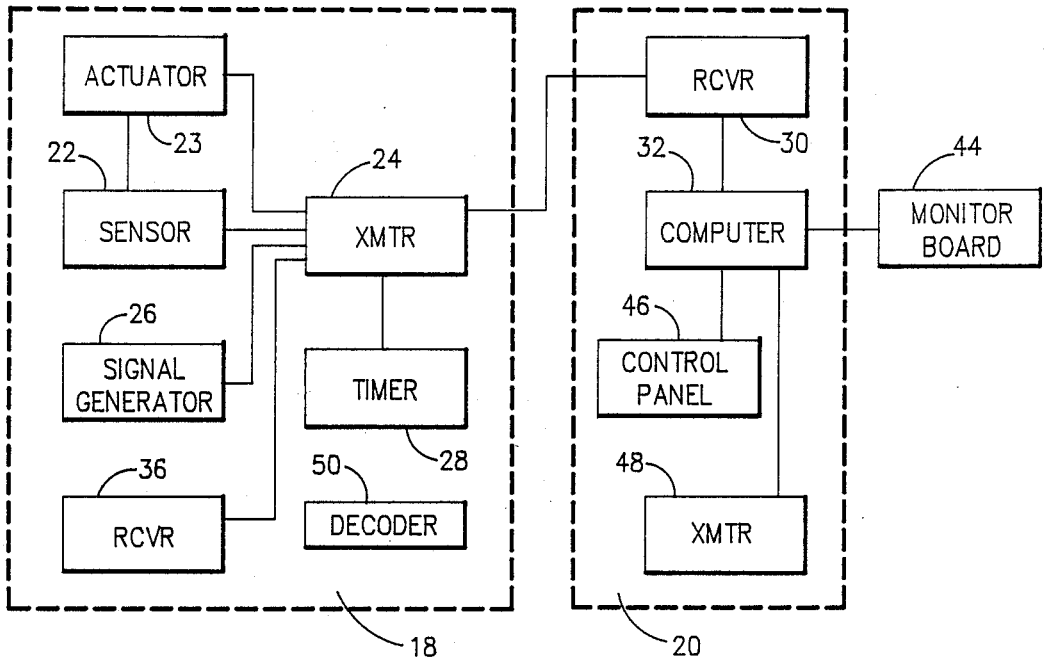
FIG. 3 is a block diagram of a typical configuration of the monitoring system of the golf carts and monitor station.

In the preferred embodiment, each golf cart 12 is provided with an antenna 14 which is attached to the associated circuitry 18 such as that shown in FIG. 3. Antenna 14 may transmit to, and receive RF signals from, antenna 16 of monitor station 10, antenna 16 being attached to the associated circuitry 20 of FIG. 3. As seen, circuitry 18 includes a sensing device 22 for sensing ignition of cart 12 such that signals will be emitted by transmitter 24 only when the motor of cart 12 is running. In this way, carts 12 which are parked and not in use will not emit undesirable signals. Selective actuator 23 is provided such that a golfer may override sensor 22 by pushing a button, or other such actuating means, on the dashboard of cart 12 as explained later. An ID signal generator 26 provides a coded digital signal to transmitter 24 as, for example, a unique binary signal indicative of the identification number of cart 12. A timer 28 controls the timing sequence of circuit 18 so that transmitter 24 will transmit only at predetermined intervals in order to minimize the likelihood of simultaneous transmissions by a plurality of carts. The invention may be implemented with relatively simple RF communications or telemetry devices. Certain frequencies are reserved for devices of this type. Reference is made to 47 C.F.R. 15. It will also be obvious to those skilled in the art that other types of communication devices may be employed, such as induction transmitters or those operating in the ultrasonic range.

Figure 4:
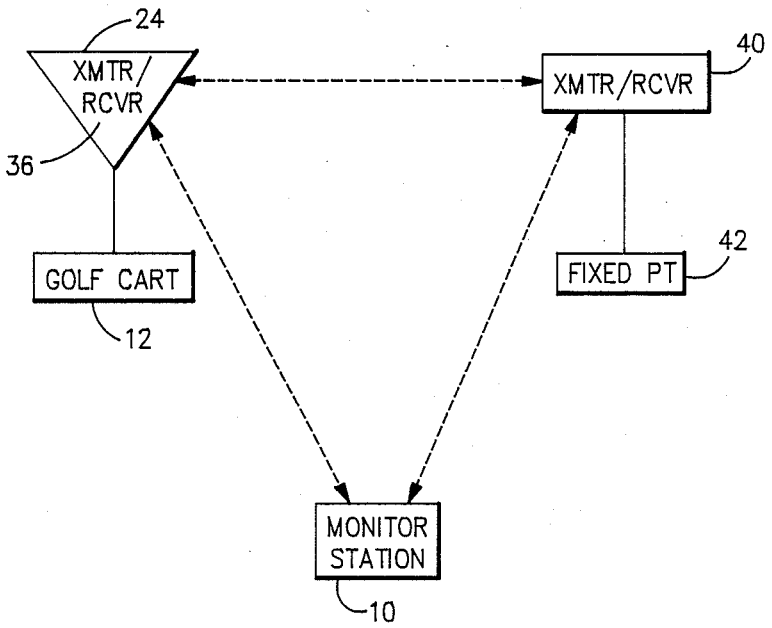
FIG. 4 is a block diagram illustrating the use of the monitoring system in a triangulation locating system.

The signal transmitted by cart antenna 14 is received by antenna 16 and provides, in addition to cart identification, a directional bearing from the cart to the receiving location. For some golf course layouts, such information may be sufficient to monitor cart location. In other situations, where more precise location is desired, an additional fixed location may be provided with transmitting and receiving means in order to establish cart position by triangulation techniques. For example, as indicated in FIG. 4, transmitter/receiver device 40 is positioned at fixed point 42, spaced a suitable distance from both monitor station 10 and from the path of travel of carts about the course.

The signal transmitted from the cart is received at both locations 10 and 42, providing the bearing of the cart from each location. A signal from location 42, indicating both cart ID and bearing, is transmitted from location 42 to the receiver at position 10. By matching cart ID with the bearing signals received at the two spaced locations, the position of the cart is easily and quickly calculated in computer 32. The resulting position signal may be utilized to drive circuitry in monitor board 44, shown in the block diagram of FIG. 3 and the more representational view of FIG. 6. Depending upon the level of sophistication desired, monitor board 44 may display the entire course layout with the instantaneous position of each cart, as the signals representing cart ID and location are received; alternatively, an alphanumeric display may simply indicate cart number and the particular hole at which each cart is located at any given time.

Figure 6:
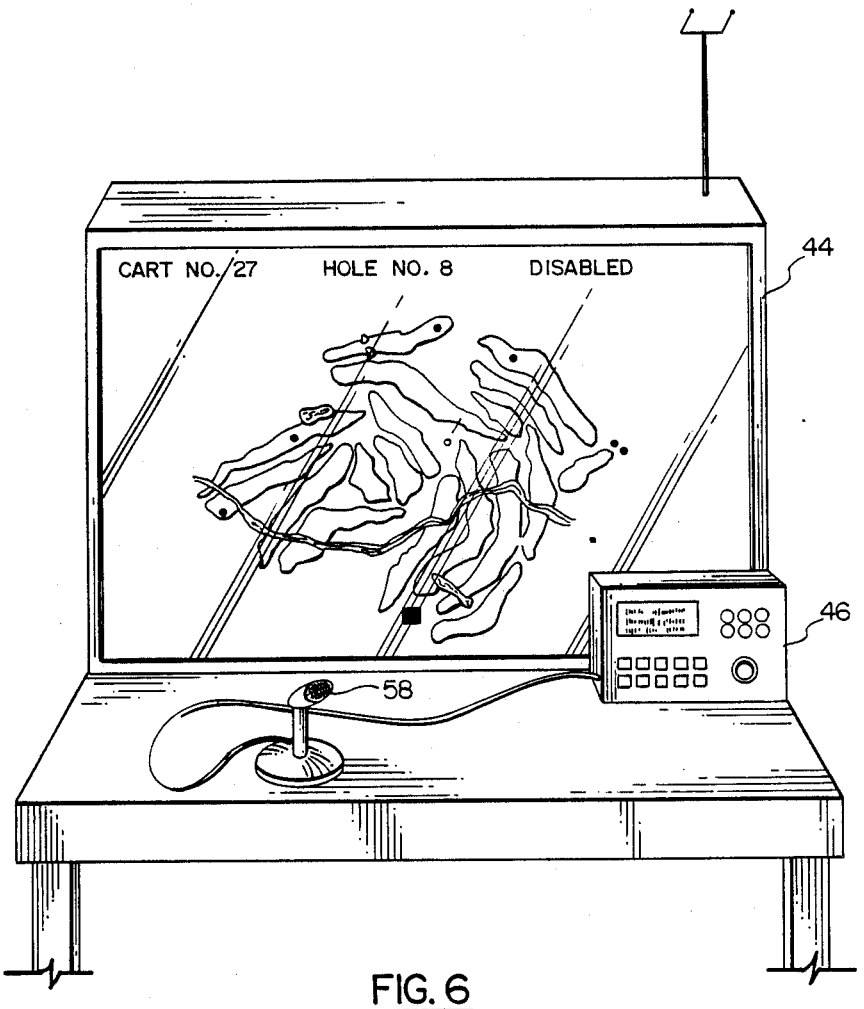
FIG. 6 is a perspective view of the monitor screen of the Pro Shop of FIGS. 1 and 2.

The function of monitoring slow play may be performed by an attendant observing monitor board 44 and its indication of cart progress. For example, in addition to the fixed display of the course layout, which may be in the form of an overlay on the screen of monitor board 44, a plurality of light emitting diodes (LEDs), or liquid crystal display (LCD) means are arranged in the screen for selective actuation by computer 32 in response to the signals received from each operating cart. That is, the cart ID and position signals from computer 32 drive the LED or LCD at the appropriate position on the screen of monitor board 44, thereby providing a visual display of the position of each cart at any given time. Slow play which is impeding the orderly progress of carts on the course is evidenced by the presence of a plurality of carts at one location, usually with no carts present on one or more succeeding holes. This condition is observed by the attendant on monitor board 44, who may thus readily identify the cart causing the bottleneck. A control panel 46 is provided in proximity to monitor board 44, and is connected to computer 32, as seen in FIGS. 6 and 3, respectively. A keypad, or other such data entry means on panel 46, permits the attendant to enter the number of the offending cart and, upon pressing an "execute" key on the control panel a signal is transmitted via transmitter 48, such signal including a code unique to the designated cart. Upon reception by receiver 36, the signal is decoded by decoder 50. Upon decoding at the designated cart, this signal causes a buzzer connected to speaker 52, or other such alarm device on the cart in question, to sound for a few seconds, thereby alerting the golfers using this cart that they must complete play on the hole and move on. If the cart has not moved within a further predetermined time period following the first alarm, e.g., 30 seconds to 1 minute, a second signal is transmitted to the same cart which may, for example, produce a continuous, audible alarm until the cart is moved to the next hole.

Figure 5:
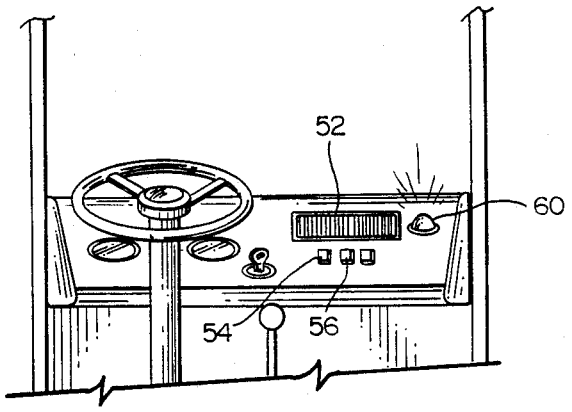
FIG. 5 is a perspective view of a typical dashboard of a golf cart used in practicing the invention.

In addition to providing a method of monitoring slow play, the communications system between the individual carts 12 and monitor station 10 may be used to implement additional functions. For example, manually operable buttons may be provided on the carts, as previously mentioned, to cause transmitter 24 to emit signals in addition to the cart ID and bearing information. Appropriate graphics would inform the golfer of the function of each button, such as those shown on the cart dashboard in FIG. 5. Pushing button 54, for example, will cause transmitter 24 to emit a specially coded signal which alerts monitor station 10 of cart malfunction. In a alternate embodiment, actuator 23 could have automatic means which would cause transmitter 24 to emit a malfunction signal whenever sensor 22 perceived the motor of cart 12 was off for a reason other than manually turning off the ignition.

The malfunction signal would be decoded in computer 32 and would drive an alphanumeric display on monitor board 44, alerting the attendant to the malfunction as indicated in FIG. 6, so that assistance may be dispatched without requiring the golfer to return to the Pro Shop.

Button 56 may be provided to cause transmission of a uniquely coded signal indicating the presence of a medical emergency, or other condition requiring immediate assistance, at the transmitting cart. Microphone 58 may be provided at the monitoring station to permit direct, voice communication of the attendant with all carts in response to actuation of a designated key on control panel 46. By proper design of transmitter 48 and receiver 36, such voice communication could be implemented with the previously described circuitry, the voice communication being audible through speaker 52. Such voice communication could be used, for example, to instruct all carts to return to the Pro Shop in the event of lightning, or other severe weather conditions. Alternatively, this function could be implemented by transmitting a signal from monitor station 10 which would cause lamp 60 on the dashboard of each cart to flash on and off, or to remain illuminated.

What is claimed is:

1. A method of monitoring the progress of each of a plurality of golf carts along a prescribed sequence of holes on a golf course in order to mitigate the effects of unacceptably slow play by golfers using said carts, said method comprising:

(a) transmitting from each of said carts by wireless means, a first signal, electrically perceptible at locations remote from said carts, each of said carts transmitting said first signal at first predetermined time intervals, said first signal transmitted by each of said carts including an identification code unique to the associated cart;

(b) receiving said first signal from each of said carts at a first, fixed location by receiving means adapted to distinguish said identification code and to provide a directional bearing between said first location and each of said carts from which said first signal is transmitted;

(c) determining from said identification code and directional bearing the location on said golf course of each of said carts, at least at periodic intervals;

(d) observing the occurrence of a plurality of carts in substantially the same location on said golf course, such observation indicating unacceptably slow play by the golfer(s) using one of said carts at said same location;

(e) identifying said one of said carts;

(f) transmitting from said first location by wireless means a second signal, electrically perceptible at said carts, said second signal including an identification code unique to said one of said carts;

(g) receiving said second signal and decoding said identification code at said one of said carts; and (h) actuating an alarm device on said one of said carts in response to said second signal to provide a perceptible warning to individuals in the vicinity of said one of said carts that their play is unacceptably slow.

2. The method of claim 1 wherein said first and second signals are RF signals.

3. The method of claim 2 and further including displaying on a monitor board responsive to said first signals, a visual display indicating the positions of said carts on said course.

4. The method of claim 1 wherein said alarm device produces an audible signal.

5. The method of claim 1 and including the further steps of:

(a) sounding said audible alarm device in a first manner in response to reception of said second signal at said one of said carts;

(b) observing whether said one of said carts has moved from said same location within a second time interval, following transmission of said second signal;

(c) transmitting a third signal from said first location, said third signal including a code unique to said one of said carts, in response to failure of said one of said carts to move substantially from said same location within said second time interval;

(d) receiving and decoding said third signal at said one of said carts; and (e) sounding said audible alarm device in a second manner in response to receipt of said third signal at said one of said carts.

6. The method of claim 1 and further including determining the position of each of said carts on said course by triangulation from signals transmitted by and received from each of said carts at a plurality of fixed locations.

7. The method of claim 1 and further comprising transmitting a uniquely coded signal from any one of said carts, receiving said uniquely coded signal at an attended station, and providing a perceptible indication of receipt of said uniquely coded signal.

8. The method of claim 7 wherein said uniquely coded signal is transmitted in response to manual actuation of actuating means on the cart.

9. The method of claim 7 wherein said perceptible indication comprises a visual display alerting an attendant at said station of a malfunction of the cart transmitting said uniquely coded signal.

10. The method of claim 9 wherein said uniquely coded signal is transmitted automatically in response to other than intentional removal of power from the cart motive means.

11. The method of claim 1 wherein said first signal is transmitted at said first time intervals whenever power is supplied to the motive means of said cart.

12. The method of claim 1 and further comprising:

(a) receiving said first signal at a second, fixed location, thereby providing a directional bearing between said cart and said second location;

(b) transmitting a third signal by wireless means from said second to said first location, said third signal being commensurate with said directional bearing between said cart and said second location;

(c) receiving said third signal at said first location; and (d) determining the location of said cart by triangulation from said first and third signals.

* * * * *